United States Patent [19]

Fatula, Sr.

[11] 4,428,158

[45] Jan. 31, 1984

[54] METHOD AND APPARATUS FOR GRINDING IRREGULAR SURFACES

[75] Inventor: James J. Fatula, Sr., Ellwood City, Pa.

[73] Assignee: Ryman Engineering Company, Ellwood City, Pa.

[21] Appl. No.: 276,792

[22] Filed: Jun. 24, 1981

[51] Int. Cl.[3] ..... B24B 7/02

[52] U.S. Cl. ..... 51/33 R; 51/35; 51/241 S; 409/175; 409/180; 409/202

[58] Field of Search ..... 51/241 S, 252, 254, 51/34 A, 34 C, 34 D, 34 E, 34 F, 34 G, 35, 33 R; 409/175, 180, 190–191, 202; 144/285

[56] References Cited

U.S. PATENT DOCUMENTS

| | | | |
|---|---|---|---|
| 2,524,332 | 10/1950 | Sichel | 51/241 S |
| 2,788,617 | 4/1957 | Pelkett | 51/34 G |
| 3,156,072 | 11/1964 | Boehme | 51/35 X |
| 4,271,638 | 6/1981 | Greech | 51/241 S |

FOREIGN PATENT DOCUMENTS

| | | | |
|---|---|---|---|
| 551156 | 4/1977 | U.S.S.R. | 51/34 C |

*Primary Examiner*—E. R. Kazenske
*Assistant Examiner*—Douglas D. Watts
*Attorney, Agent, or Firm*—Martin J. Carroll

[57] ABSTRACT

A tool for grinding irregular surfaces such as transition welds includes a base adapted to rest on the surface of the workpiece, a track on the base and a carriage which moves longitudinally of the weld with one end on the track and the other end of the carriage having a roll which contacts the top of the workpiece. A trolley is supported on the carriage for transverse movement and carries a grinding wheel and its motor. Guide tracks on the carriage cause the grindling wheel to move in a non-linear path. The base is placed in position and the grinding wheel is reciprocated transversely as the carriage reciprocates longitudinally. If the weld is longer than the carriage movement, the base is moved after the grinding is finished at the first position to a second position adjacent thereto and the operation is repeated until the weld is completely ground as desired.

8 Claims, 6 Drawing Figures

METHOD AND APPARATUS FOR GRINDING IRREGULAR SURFACES

This invention relates to apparatus for grinding and more particularly to a portable grinder suitable for grinding various types of surfaces in the field. One such use is grinding the transition welds on beams or the like having at least two widths and/or heights. Also it is common to weld pieces end to end with the weld extending above the surface for reinforcement. These welds must be ground to prevent stress risers. In some instances it is necessary to grind material to obtain a flat surface below other surfaces. In so far as I am aware, all of this grinding in the field has been done with a hand grinder which is held and manipulated by the workman or in some cases by semi-automatic equipment which is only semiportable. The weight of the grinder is considerable so that the workman becomes tired. In addition, it requires a skilled workman to obtain a good surface and avoid undercutting so that it is quite common to obtain relatively poor finished surfaces. Such surfaces do not look good and even more objectionable is the possibility of getting work which is weak or subject to early failure. Thus this method of grinding is slow, expensive and unreliable at times.

It is therefore an object of my invention to provide a portable grinder suitable for grinding surfaces without manipulation by a workman during the grinding operation.

Another object is to provide such a grinder which is relatively light in weight so that it can be positioned by one or two workmen.

A further object is to provide such a grinder which requires relatively little skill for operation.

Still another object is to provide a method of grinding an irregular surface which is cheaper, faster and more reliable than previous methods.

These and other objects will be more apparent after referring to the following specification and attached drawings in which.

Figure 1:
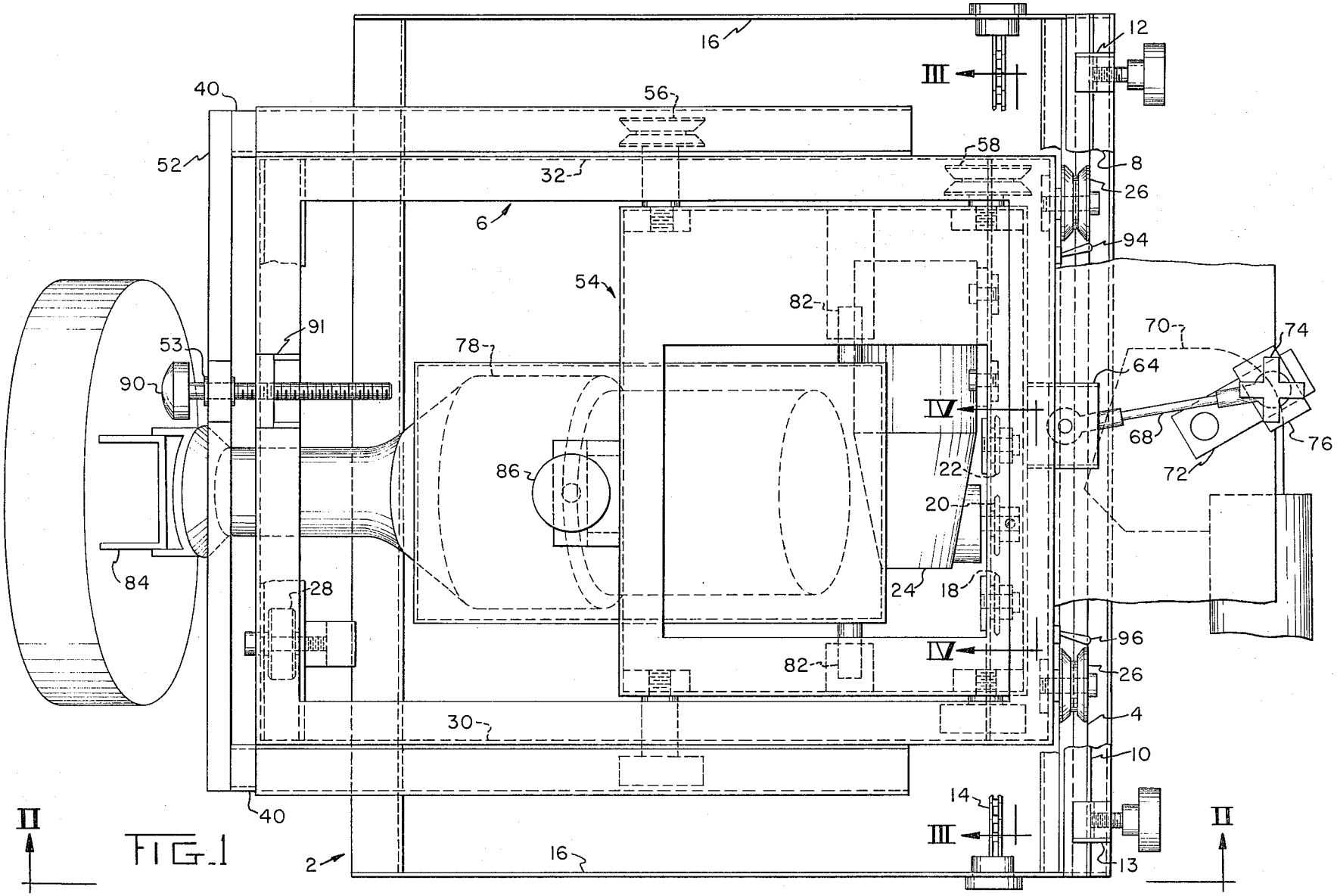
FIG. 1 is a plan view of the grinder of my invention.

Referring more particularly to the drawings reference numeral 2 indicates the base of my machine. The base 2 is preferably fabricated from aluminum sheets and has a longitudinal track 4 at its rear for supporting a carriage 6. The base 2 includes a horizontal flange 8 above and parallel to track 4 with a vertical flange 10 extending upwardly therefrom. Adjustable stops 12 and 13 are mounted on flange 10 for limiting movement of carriage 6. A longitudinal horizontal chain 14 extends between end walls 16 of base 2.

Figure 2:
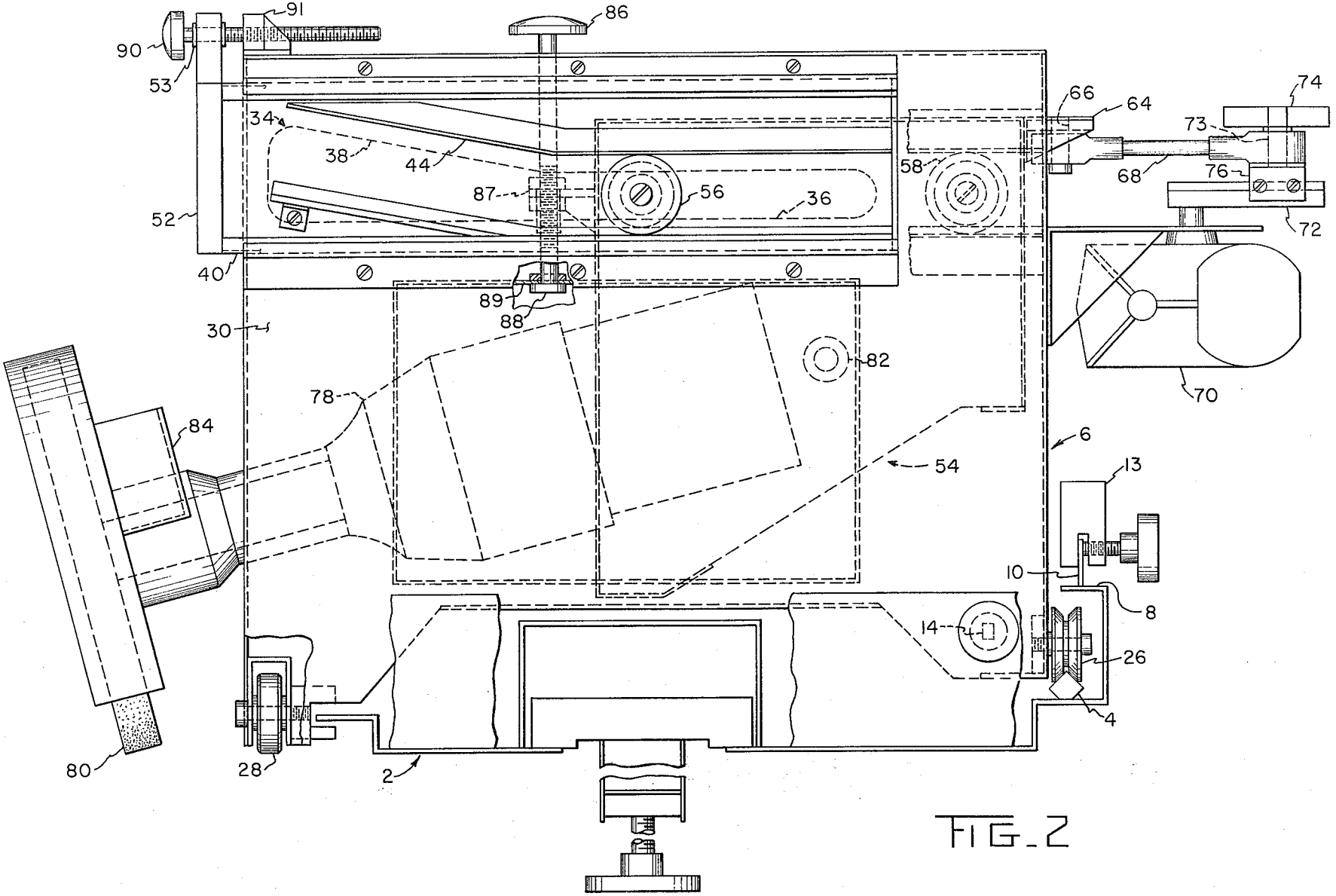
FIG. 2 is a view taken on the line II—II of FIG. 1.
Figure 3:
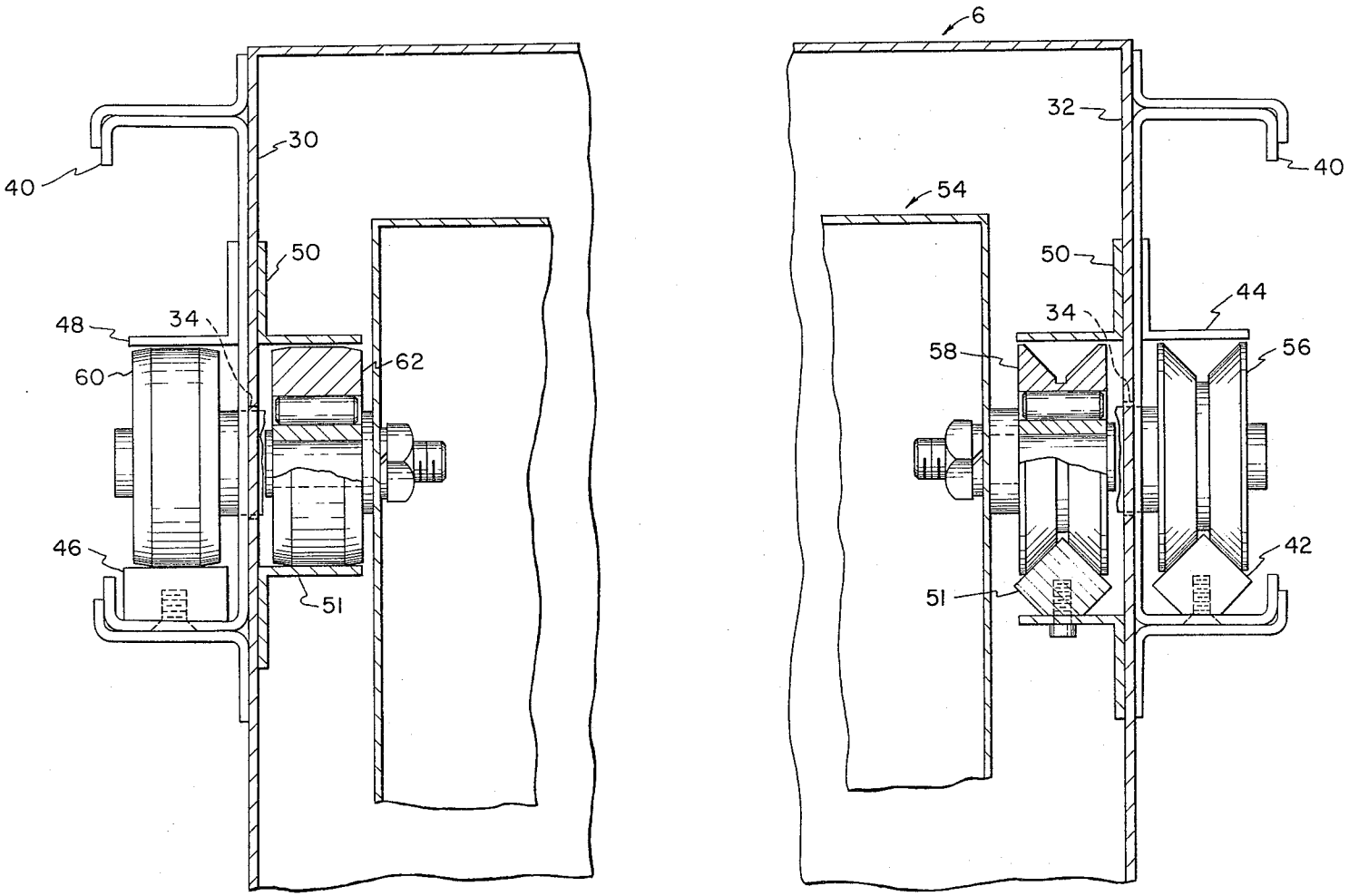
FIG. 3 is a view taken on the line III—III of FIG. 1.
Figure 4:
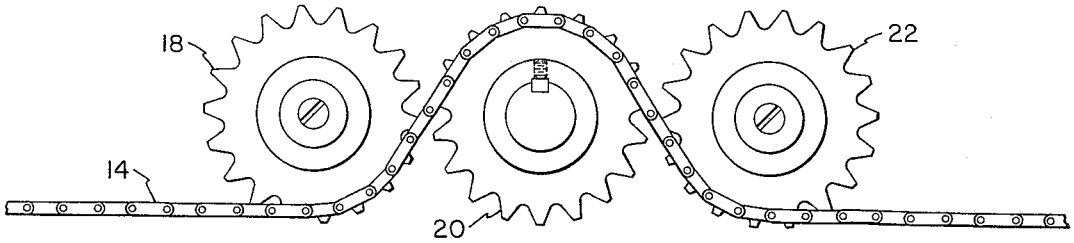
FIG. 4 is a view taken on the line IV—IV of FIG. 1.
Figure 5:
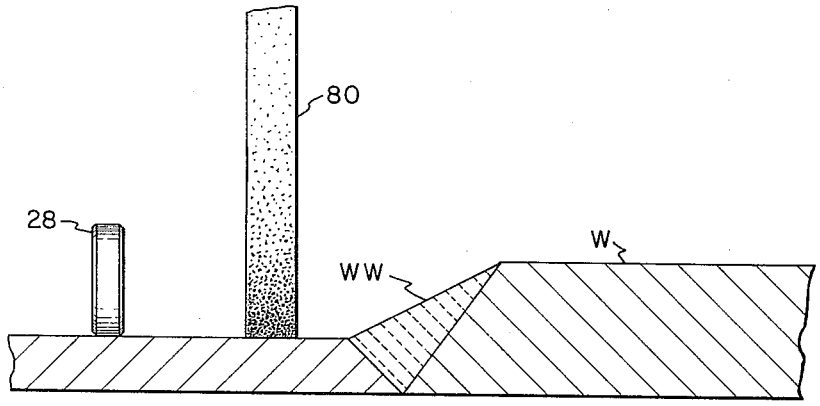
FIG. 5 is an enlarged view, partly in section, of the grinding wheel in position on the workpiece.

Mounted on the rear of carriage 6 are three sprockets 18, 20 and 22 with their axes horizontal and transverse to track 4. As best shown in FIG. 4, the claim 14 passes under sprocket 18, up and around the top of sprocket 20 and under sprocket 22. Sprocket 22 is rotated by motor 24 mounted on carriage 6. Also mounted on carriage 6 at each end are rolls 26 which ride on track 4. Mounted on the front of carriage 6 is a follower roll 28 which is adapted to contact the top of workpiece W as shown in FIG. 5. The carriage 6 includes spaced side walls 30 and 32. Aligned slots 34 are provided in each wall 30 and 32 and are provided with a rear horizontal portion 36 and a forward upwardly slanting portion 38. As best shown in FIGS. 1, 2 and 3 a track holder 40 is slidably secured to the outside of wall 32 and supports a V-shaped bottom track or guide 42 having a rear horizontal portion and a forward upwardly slanting portion corresponding with slot 34. The holder 40 also supports an upper track or guide 44 spaced from and parallel to track 42. Tracks or guides 46 and 48 similar to but of opposite hand to tracks 42 and 44 are supported by a track holder 40 slidably secured to the outside of wall 30. The bottom track 46 is flat rather than V-shaped. Mounted on the inside of each wall 30 and 32 are horizontal top and bottom tracks or guides 50 and 51 extending forwardly from the rear of carriage 6. Bottom track 51 on wall 32 is V-shaped and that on wall 30 is flat. The forward ends of track holders 40 are connected by a cross-member 52 so that they move in unison. A collar 53 is secured to the member 52 for a purpose which will appear later.

A transverse trolley 54 is mounted between walls 30 and 32 for movement on tracks 42 and 51. For this purpose a grooved idler roll 56 is secured to trolley 54 adjacent its forward end and is received between guides 42 and 44 and a similar grooved roll 58 is secured to trolley 54 rearwardly of roll 56 and received between guides 50 and 51. Similarily rolls 60 and 62 secured to trolley 54 in alignment with rolls 56 and 58, respectively are received between guides 46 and 48 between guides 50 and 51.

A bracket 64 is secured to the rear of trolley 54 and has a vertical hole 66 therein for pivotally connecting the trolley to an arm 68. A motor 70 is mounted on carriage 6 adjacent bracket 64 and drives crank arm 72 which is pivotally connected to the free end of arm 68 by means of pin 73 having a locking knob 74 at one end and a nut 76 on its other end slidable on crank arm 72. By loosening locking knob 74 the effective length of crank arm 72 may be changed to vary the length of movement of trolley 54. Grinder motor 78 which has a grinder wheel 80 at the end of its shaft is pivotally connected to trolley 54 by means of shaft 82 extending between the side walls of the trolley adjacent its rear end. A box 84 is mounted on the grinder motor assembly adjacent the wheel 80. Weights may be placed in the box 84 so as to provide a counterweight force for best operation. The vertical position of the grinding wheel may be varied by means of a screw 86 passing through a sliding collar nut 87 secured to trolley 54 and through a rotatable collar 88 positioned below plate 89 forming part of the grinding wheel assembly. This limits downward movement of the grinder assembly while permitting upward movement against the weight of the box 84.

The position of the trolley guides 40 may be adjusted toward and away from the workpiece by means of a screw 90 passing through nut 53 and into a nut 91 secured to carriage 6. By this adjustment movement of the trolley may be limited to the horizontal part of the track for grinding flat surfaces or positioned for best operation over a sloping surface.

Figure 6:
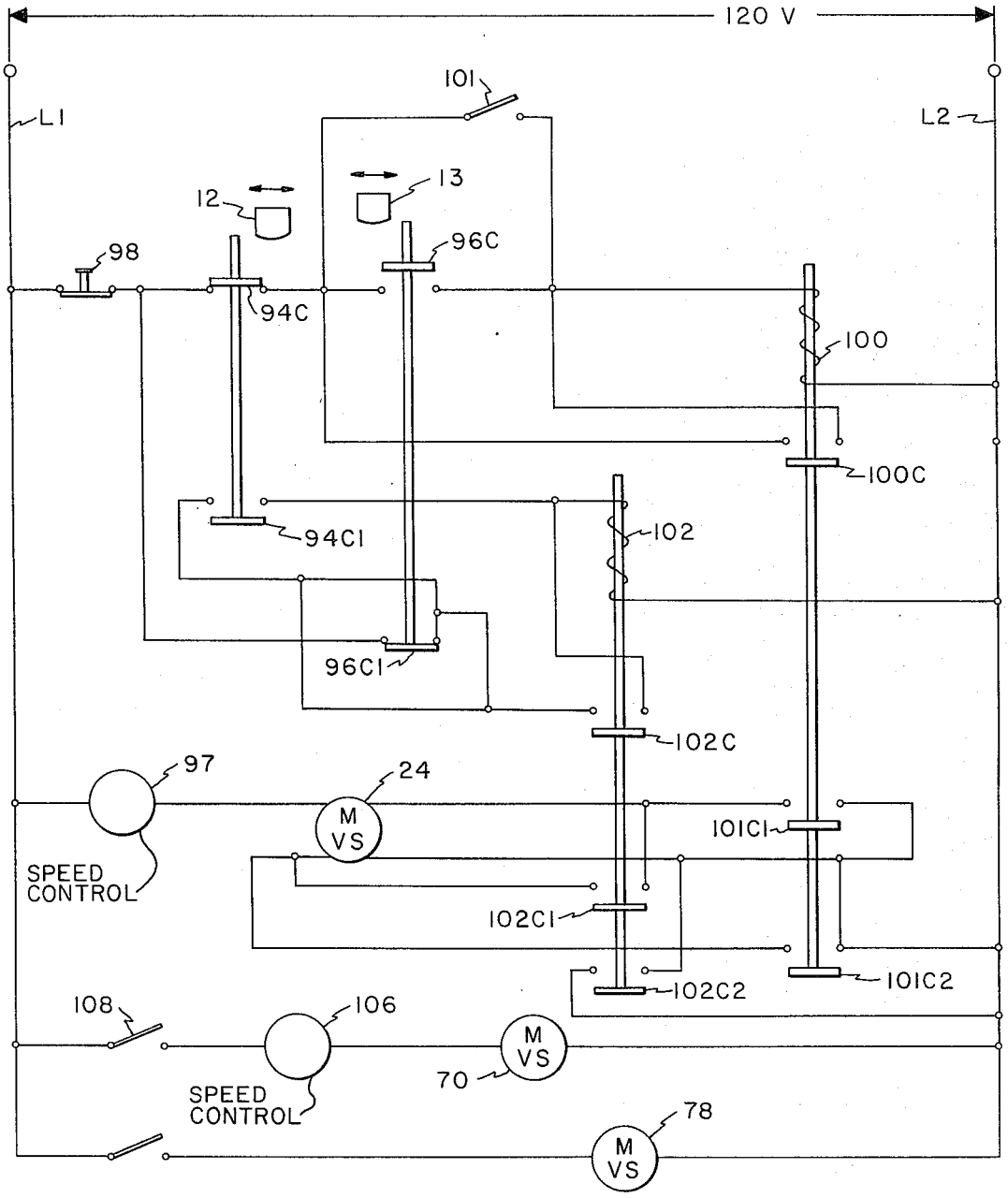
FIG. 6 is a schematic wiring diagram of the electrical controls of the grinder.

Limit switches 94 and 96 are located in longitudinally spaced relationship on the back of carriage 6. As shown in FIG. 6 limit switch 94 has normally closed contact 94C and normally open contact 94C1 while switch 96 has normally open contact 96C and normally closed contact 96C1. Power for operating traversing motor 24 is obtained from power source L1–L2 through a speed control 97. The control circuit includes normally closed switch 98 which can be depressed to stop the operation and which is connected in series with contacts 94C and 96C and relay coil 100 having normally open contacts 100C, 100C1 and 100C2. Start switch 101 is connected in parallel with contact 96C. Contact 100C is connected in parallel with contact 96C. Contact 96C1, contact 94C1 and relay coil 102 are connected in series with switch 98 and in parallel with the 94C, 96C and coil 100 circuit. Coil 102 has normally open contacts 102C, 102C1 and 102C2. Contact 102C is connected in parallel with contact 94C1. Contacts 101C1, 101C2, 102C1 and 102C2 are connected in the reversing circuit of motor 24.

To operate traverse motor 24, switch 101 is closed which energizes relay coil 100 closing all its contacts. Closing of contact 100C locks the relay coil 100 in. Closing of contacts 100C1 and 100C2 energizes motor 24 to cause it to operate to move carriage 6 in what may be termed the forward direction of the direction toward limit switch 94. When limit switch 94 is contacted its contact 94C will open cutting off flow of current to motor 24, but at the same time contact 94C1 will close completing the circuit through relay coil 102 closing its contacts, locking it in and supplying current to motor 24 in the reverse direction to move carriage 6 in the reverse direction until limit switch 96 is actuated to open contact 96C1 and stop motor 24. At the same time contact 96C is closed to supply current to motor 24 to cause it to move carriage 6 in the forward direction until switch 98 is opened.

Current is supplied to motor 70 from power source L1, L2 through speed control 106 and switch 108.

In operation the base 2 is secured in position either to or adjacent the workpiece W in any suitable manner such as by clamping, by magnets or even by weights. The particular workpiece shown has a transition weld WW which is to be ground and wheel 28 rests on the top of the thinner portion of the workpiece. The operator adjusts the position of screw 86 and 88 to the positions desired. The motors 24 and 70 are energized as well as the grinder motor 78. This causes the carriage 6 to reciprocate longitudinally as described above and the trolley 54 to move transversely on rolls 56, 58, 60 and 62 on tracks 42 and 46 with the grinding wheel 80 swinging up along the transition weld by virtue of the bent guide. The grinding wheel also moves about the axis of shaft 82. When the transition weld section is ground to the desired shape and depth the workmen positions the assembly as before with the grinder in position to grind an adjacent section. While the machine is grinding the operator has nothing to do and it is contemplated that one operator will operate two or more machines with far less effort than when using the present hand grinder. In addition, a better and more uniform surface is obtained. Less skill is also required.

When it is desired to grind a horizontal surface the screw 90 is rotated to move the track holders 40 to a position where the trolley 54 will only move in the horizontal portions of the tracks 56, 58, 60 and 62. This may require adjustment of the effective length of the crankarm 72.

While one embodiment has been shown and described it will be apparent that other modifications and adaptations may be made within the scope of the following claims.

I Claim:

1. A portable grinder for grinding an elongated workpiece having an irregular cross section which comprises a base adapted to be secured on or adjacent the workpiece, a longitudinal track on said base adjacent the rear thereof, a pair of longitudinally spaced apart stops mounted on said base adjacent said track; a carriage mounted on said base for longitudinal movement thereon, rotatable rolls on said carriage adjacent its rear supported on said track, a rotatable follower roll mounted on the front end of said carriage and adapted to contact the top surface of said workpiece, the axes of all of said rolls being transverse to the longitudinal track, said carriage including spaced apart transverse side walls, a guide track holder slidably mounted on the outside of each side wall in opposed relationship for movement toward and away from said longitudinal track, a guide mounted in each holder, each guide including top and bottom horizontal rear sections and top and bottom front sections extending upwardly and forwardly at an angle from the means connecting said track holders, means for moving said track holders, a horizontal guide on the inside of each side wall in opposed relationship with the associated rear sections; means for moving said carriage along said longitudinal track including a reversible motor, a control for said reversible motor including a pair of longitudinally spaced apart switches mounted on the rear of said carriage and having a part adapted to contact the associated stop, means operated by each switch when actuated by contact with its associated stop to reverse rotation of said reversible motor whereby said carriage reciprocates between the limits set by said stops; a trolley mounted on said carriage for transverse movement with respect to said base, said trolley including a pair of forward rolls and a pair of rearward rolls with the forward rolls being received in said first named guide tracks and the rearward rolls in said horizontal guides, a shaft mounted on said trolley adjacent its rear with its axis extending parallel to the longitudinal track, a grinder motor pivotally mounted on said shaft, a grinding wheel driven by said grinder motor and extending forwardly a substantial distance beyond said follower roll, and means for reciprocating said trolley in said guide tracks.

2. A portable grinder according to claim 1 in which said means for reciprocating said carriage along said longitudinal track includes a pair of longitudinally spaced apart stops mounted on said base adjacent said track, a reversible motor, a pair of longitudinally spaced apart switches mounted on the rear of said carriage and having a part adapted to contact the associated stop, and means operated by each switch when actuated by contact with its associated stop to reverse rotation of said reversible motor whereby said carriage reciprocates between the limits set by said stops.

3. A portable grinder for grinding an elongated workpiece which comprises a base adapted to be secured on or adjacent the workpiece; a longitudinal track on said base; a carriage mounted on said longitudinal track; a follower mounted on the front end of said carriage and adapted to contact the surface of said workpiece; means for reciprocating said carriage along said longitudinal track; a grinder motor; a grinding wheel driven by said grinder motor and being so mounted that its grinding surface is rotating generally parallel to said longitudinal track when contacting the surface to be ground; means mounting said grinding wheel and motor on said carriage for movement toward and away from said track, said last named means including a trolley mounted on said carriage for transverse movement with respect to said base, a pair of transverse guide tracks on said carriage each having a horizontal rear section and a forward section positioned in a plane extending at an angle to the horizontal, and a shaft mounted on said trolley with its axis extending parallel to the longitudinal track for pivotally supporting said grinding wheel and motor; and means for causing reciprocating movement of said grinding wheel and motor toward and away from said track as the carriage moves along its track, said means for causing movement of said grinding wheel and motor includes means for reciprocating said trolley in said guide tracks.

4. A portable grinder according to claim 3 in which said forward section of each guide track extends upwardly at an angle to the horizontal.

5. A portable grinder according to claim 4 in which said means for reciprocating said carriage along said longitudinal track includes a pair of longitudinally spaced apart stops mounted on said base adjacent said track, a reversible motor, a pair of longitudinally spaced apart switches mounted on the rear of said carriage and having a part adapted to contact the associated stop, and means operated by each switch when actuated by contact with its associated stop to reverse rotation of said reversible motor whereby said carriage reciprocates between the limits set by said stops.

6. A portable grinder for grinding an elongated workpiece which comprises a base adapted to be secured on or adjacent the workpiece; a longitudinal track on said base; a carriage having a pair of sidewalls mounted on said longitudinal track; a follower mounted on the front end of said carriage and adapted to contact the surface of said workpiece; means for reciprocating said carriage along said longitudinal track; a grinder motor; a grinding wheel driven by said grinder motor and having its axis transverse to said longitudinal track; means mounting said grinding wheel and motor on said carriage for movement toward and away from said track, said means mounting said grinding wheel and motor on said carriage including a trolley mounted on said carriage for transverse movement with respect to said base, a guide track holder slidable mounted on the outside of each side wall in opposed relationship for movement toward and away from said longitudinal track, a guide mounted in each holder, each guide including top and bottom horizontal rear sections and top and bottom front sections extending forwardly at an angle from the associated rear sections, means connecting said track holders, means for moving said track holders with respect to said carriage, a horizontal guide on the inside of each side wall in opposed relationship with the horizontal rear sections, and a shaft mounted on said trolley adjacent its rear end for pivotally supporting said grinding wheel and motor with its axis extending parallel to said longitudinal track; and means for causing reciprocating movement of said grinding wheel and motor toward and away from said track as the carriage moves along its track, said means for causing movement of said grinding wheel and motor includes means for reciprocating said trolley in said guide tracks.

7. A portable grinder according to claim 6 including a weight mounted adjacent said grinding wheel, and means for limiting downward movement of said grinding wheel.

8. A portable grinder according to claim 7 in which said means for reciprocating said carriage along said longitudinal track includes a pair of longitudinally spaced apart stops mounted on said base adjacent said track, a reversible motor, a pair of longitudinally spaced apart switches mounted on the rear of said carriage and having a part adapted to contact the associated stop, and means operated by each switch when actuated by contact with its associated stop to reverse rotation of said reversible motor whereby said carriage reciprocates between the limits set by said stops.

* * * * *